US008150078B2

(12) United States Patent
Izuchi et al.

(10) Patent No.: US 8,150,078 B2
(45) Date of Patent: Apr. 3, 2012

(54) ELECTRET CONDENSER MICROPHONE

(75) Inventors: Toshiro Izuchi, Fukuoka (JP); Kensuke Nakanishi, Fukuoka (JP); Ryuji Awamura, Fukuoka (JP)

(73) Assignee: Hosiden Corporation, Osaka (JP)

( * ) Notice: Subject to any disclaimer, the term of this patent is extended or adjusted under 35 U.S.C. 154(b) by 756 days.

(21) Appl. No.: 12/297,576

(22) PCT Filed: Apr. 12, 2007

(86) PCT No.: PCT/JP2007/058026

§ 371 (c)(1),
(2), (4) Date: Oct. 17, 2008

(87) PCT Pub. No.: WO2007/123038

PCT Pub. Date: Nov. 1, 2007

(65) Prior Publication Data

US 2009/0226012 A1 Sep. 10, 2009

(30) Foreign Application Priority Data

Apr. 19, 2006 (JP) ..... 2006-115722

(51) Int. Cl.
*H04R 1/02* (2006.01)
*H04R 19/01* (2006.01)

(52) U.S. Cl. ..... 381/184; 381/423

(58) Field of Classification Search ..... 438/53; 257/416; 381/184, 423

See application file for complete search history.

(56) References Cited

U.S. PATENT DOCUMENTS

| | | | | |
|---|---|---|---|---|
| 7,031,480 | B2 | 4/2006 | Himori et al. | |
| 7,849,583 | B2 * | 12/2010 | Horimoto et al. | 29/594 |
| 2007/0189574 | A1 * | 8/2007 | Suzuki | 381/396 |

FOREIGN PATENT DOCUMENTS

| | | | |
|---|---|---|---|
| GB | 2124058 | | 2/1984 |
| JP | 4638680 | | 11/1968 |
| JP | 59028799 | | 2/1984 |
| JP | 10098796 | | 4/1998 |
| JP | 2001008293 | | 1/2001 |
| JP | 2001-169379 | * | 6/2001 |
| JP | 2001169379 | | 6/2001 |
| JP | 2002223498 | A | 8/2002 |
| JP | 2003078997 | | 3/2003 |

* cited by examiner

*Primary Examiner* — Calvin Lee
(74) *Attorney, Agent, or Firm* — The Webb Law Firm

(57) ABSTRACT

An electret condenser microphone is provided that can reduce parasitic capacitance and realize enhanced sensitivity. The electret condenser microphone includes a capacitor section including a fixed electrode having an electret member and a diaphragm electrode, a casing section housing the capacitor section, a circuit board including a converter circuit 4 for converting variations of capacitance of the capacitor section caused by vibrations of the diaphragm electrode to electric signals for output, and conducting elements for making the capacitor conductive with the circuit board, in which the casing section has a shape as viewed from top different from a shape of the capacitor as viewed from top to provide different distances between outer sides of the capacitor section and the casing section circumferentially of the capacitor section as viewed from top.

2 Claims, 9 Drawing Sheets

[Fig 1]
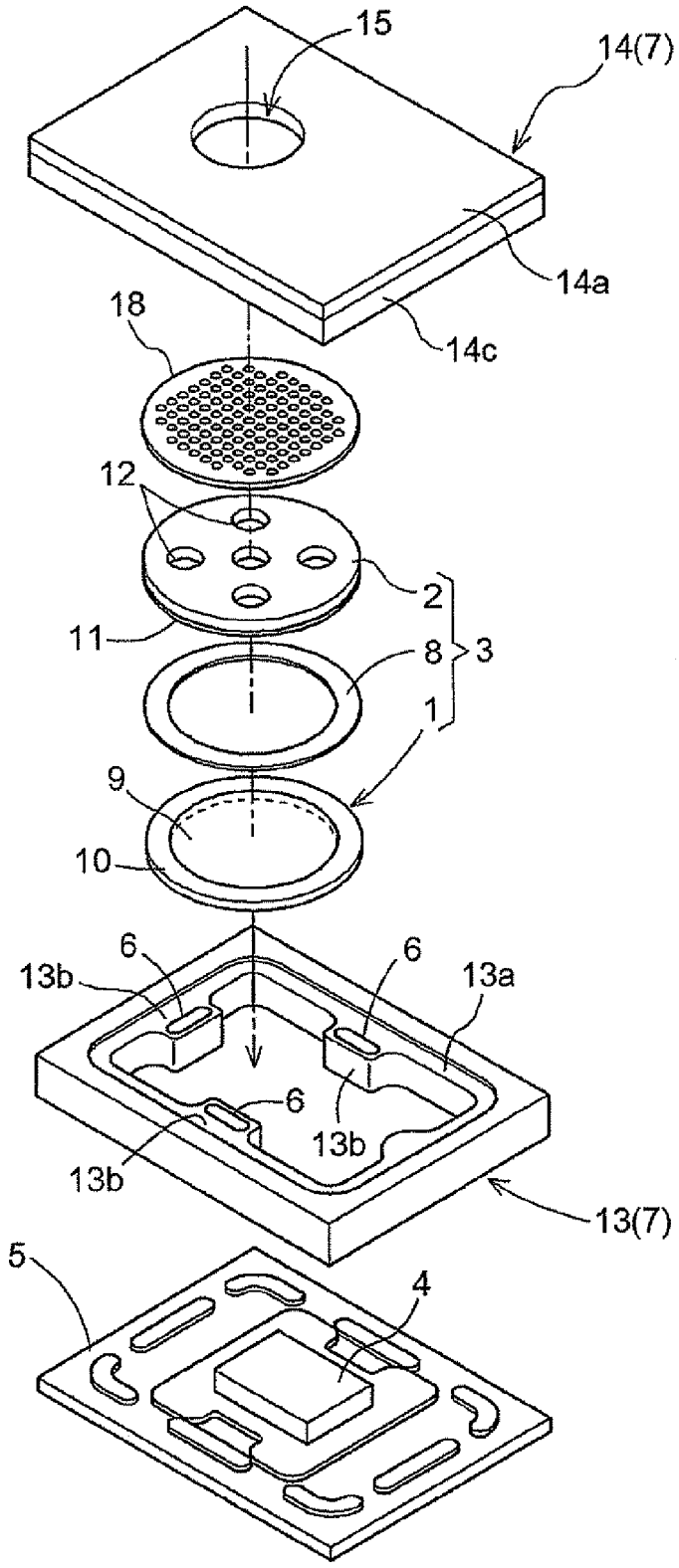

〔Fig 2〕
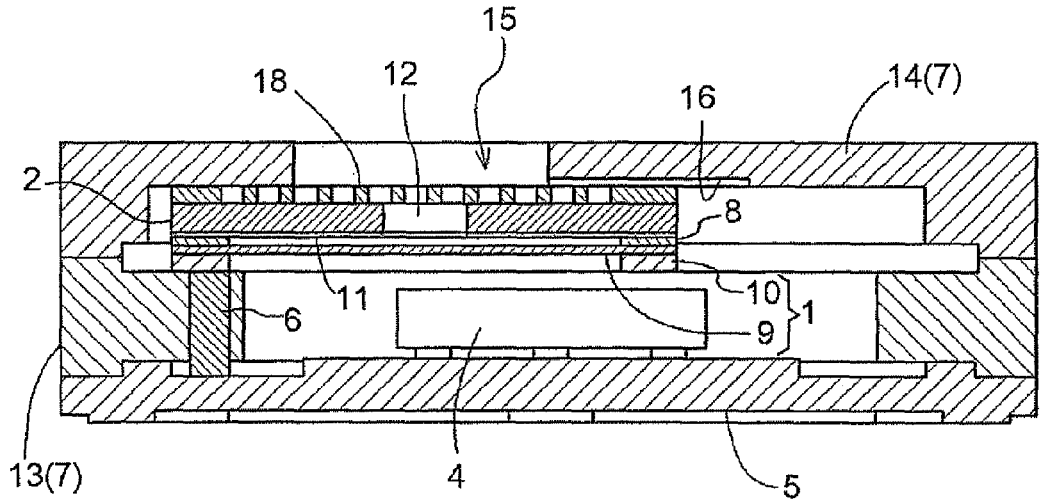
〔Fig 3〕
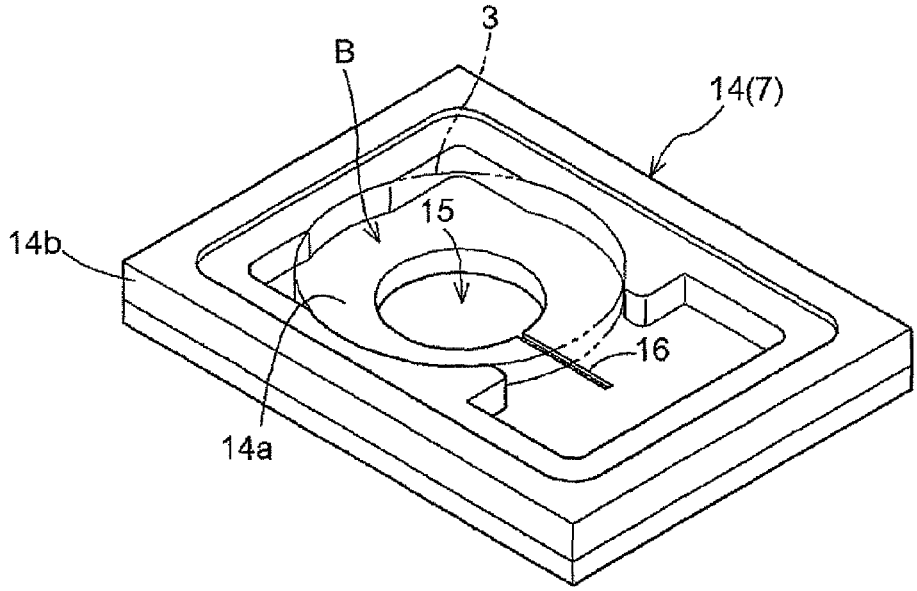

〔Fig 4〕
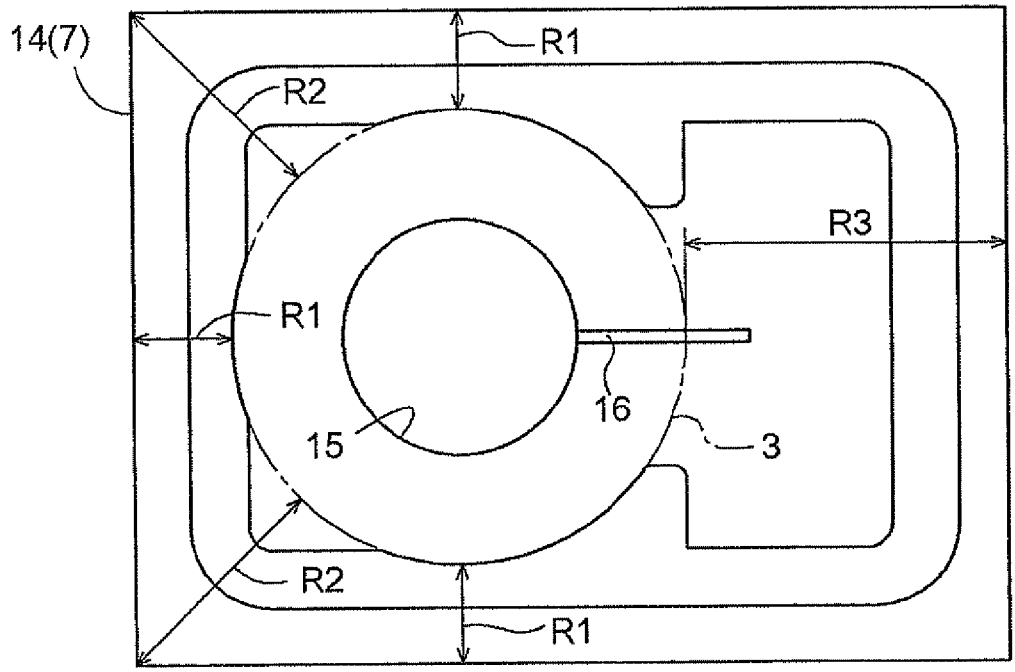
〔Fig 5〕
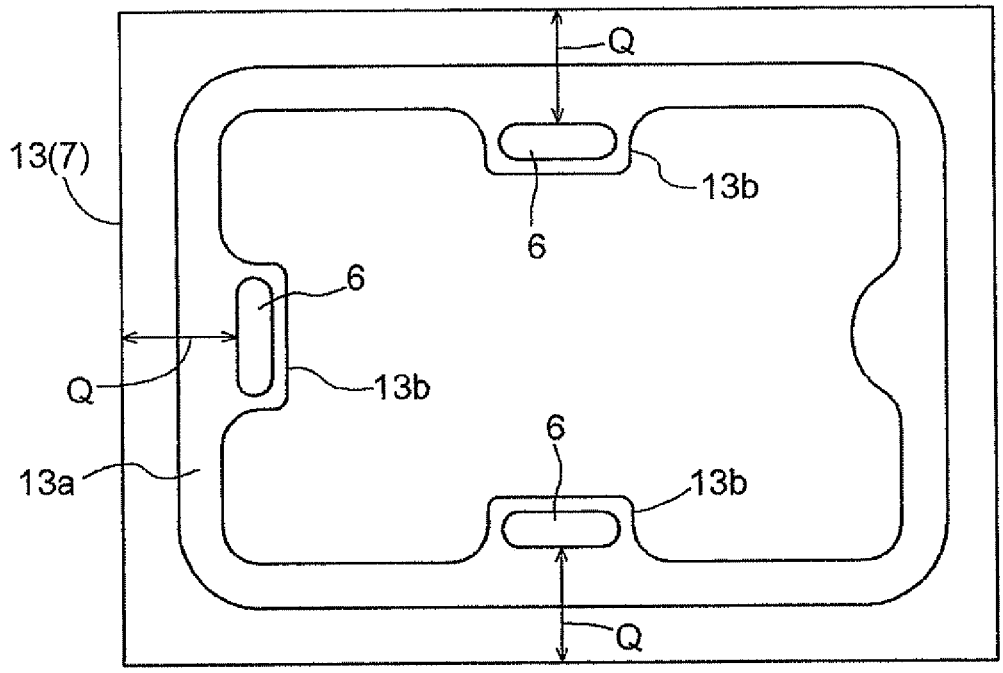

〔Fig 6〕
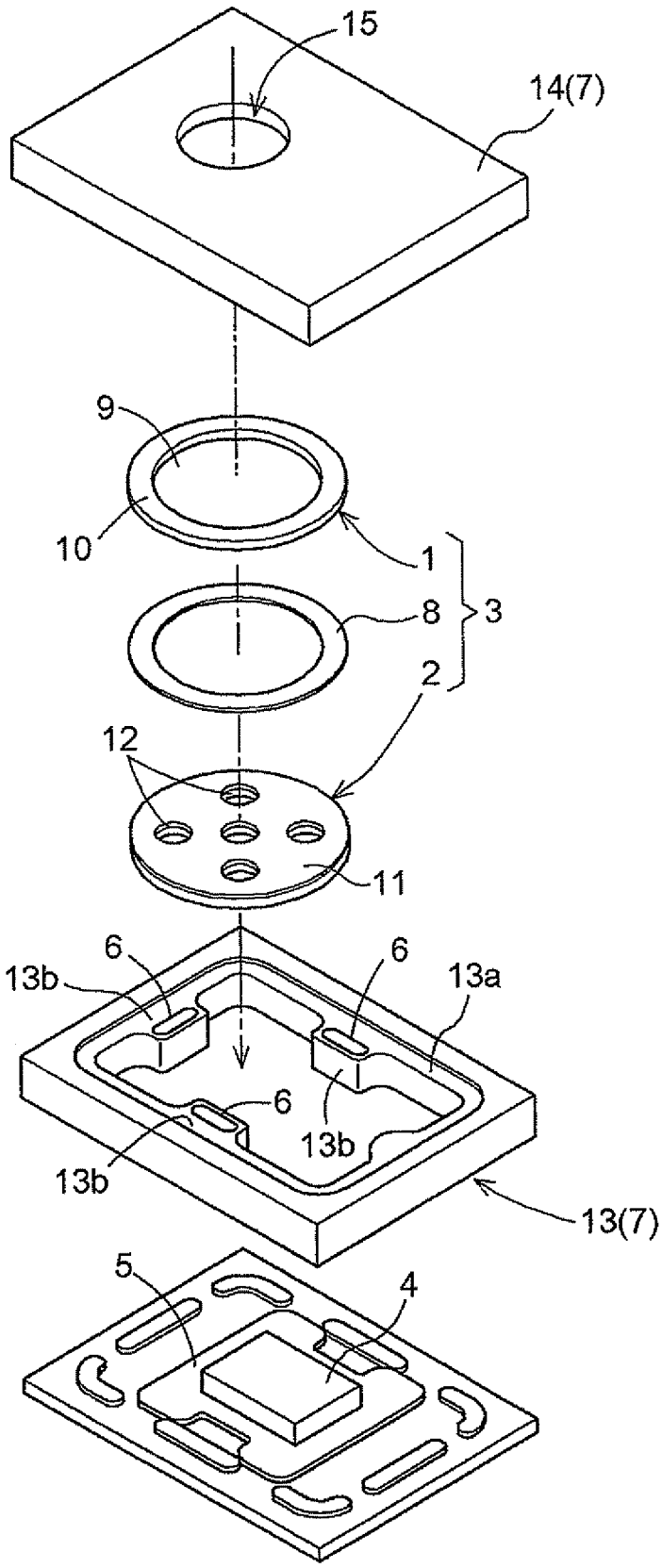

〔Fig 7〕
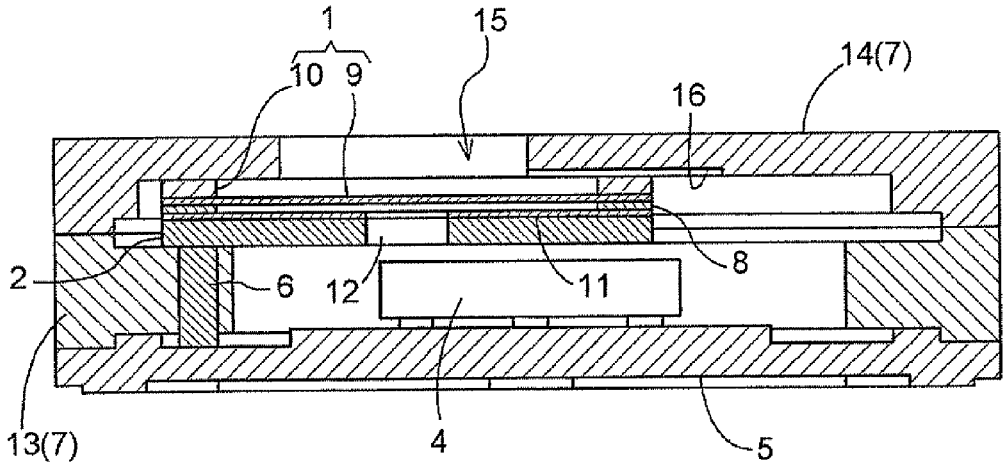

〔Fig 8〕
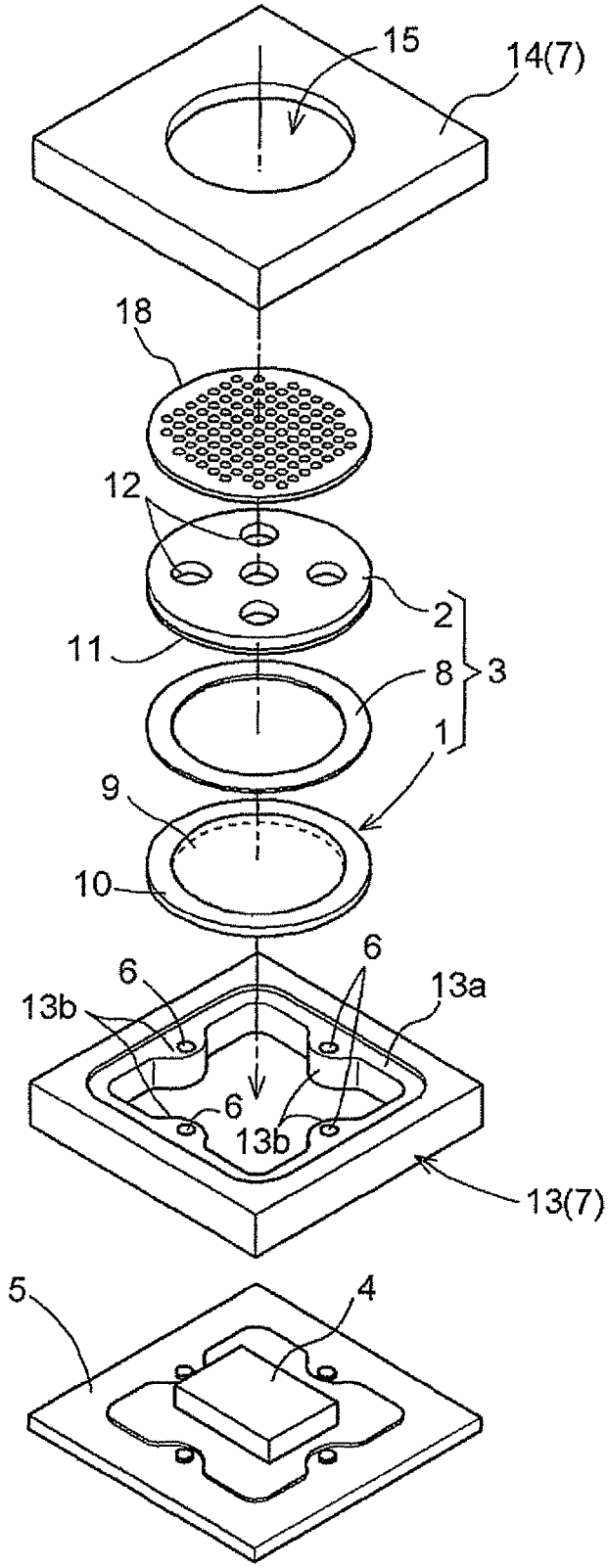

〔Fig 9〕
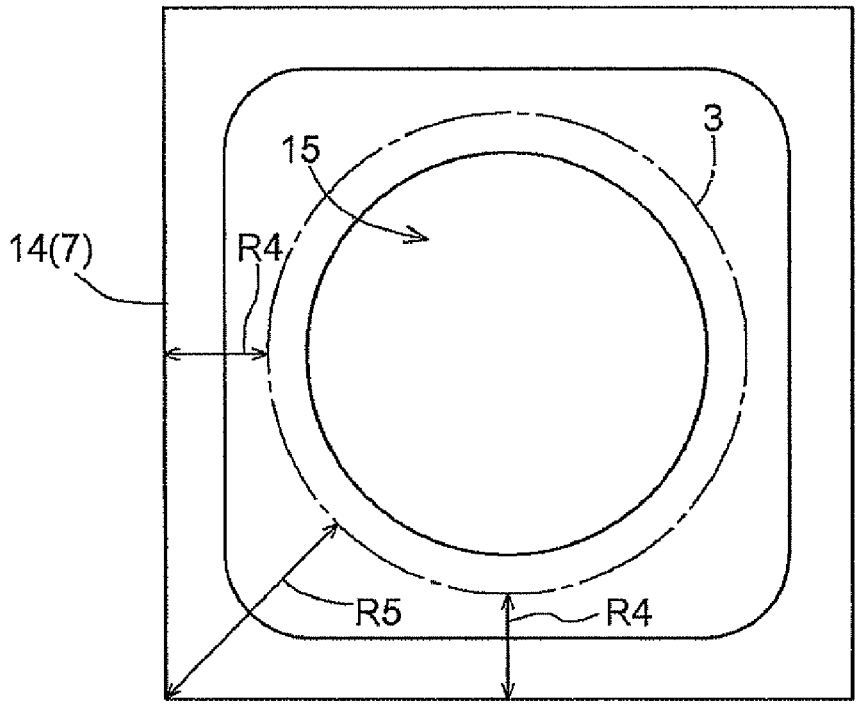
〔Fig 10〕
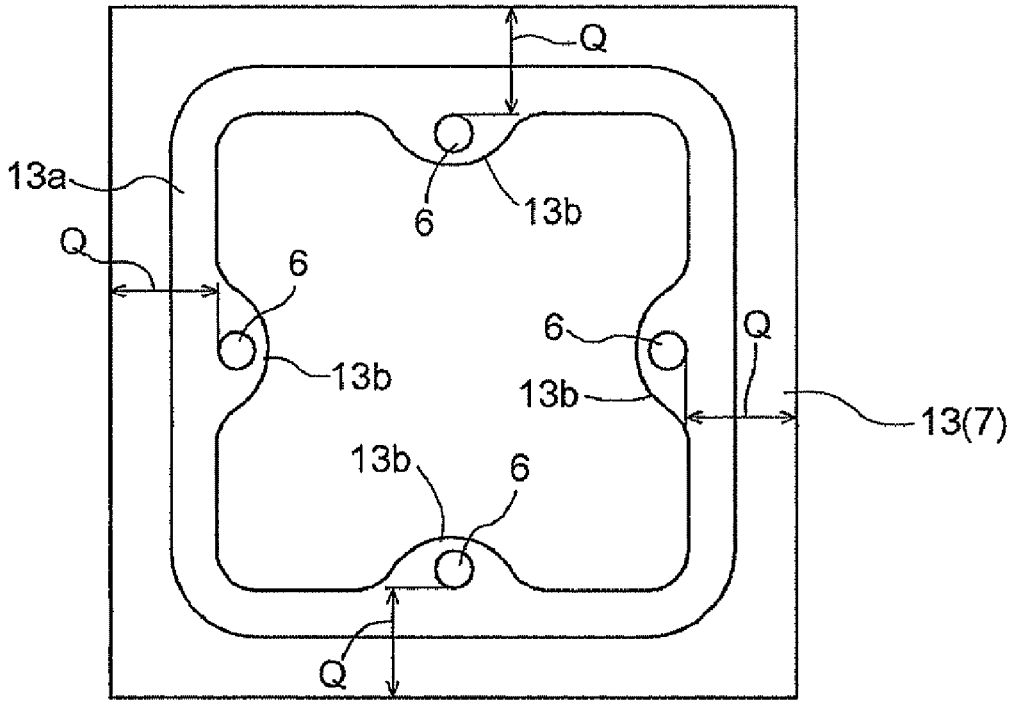

〔Fig 11〕
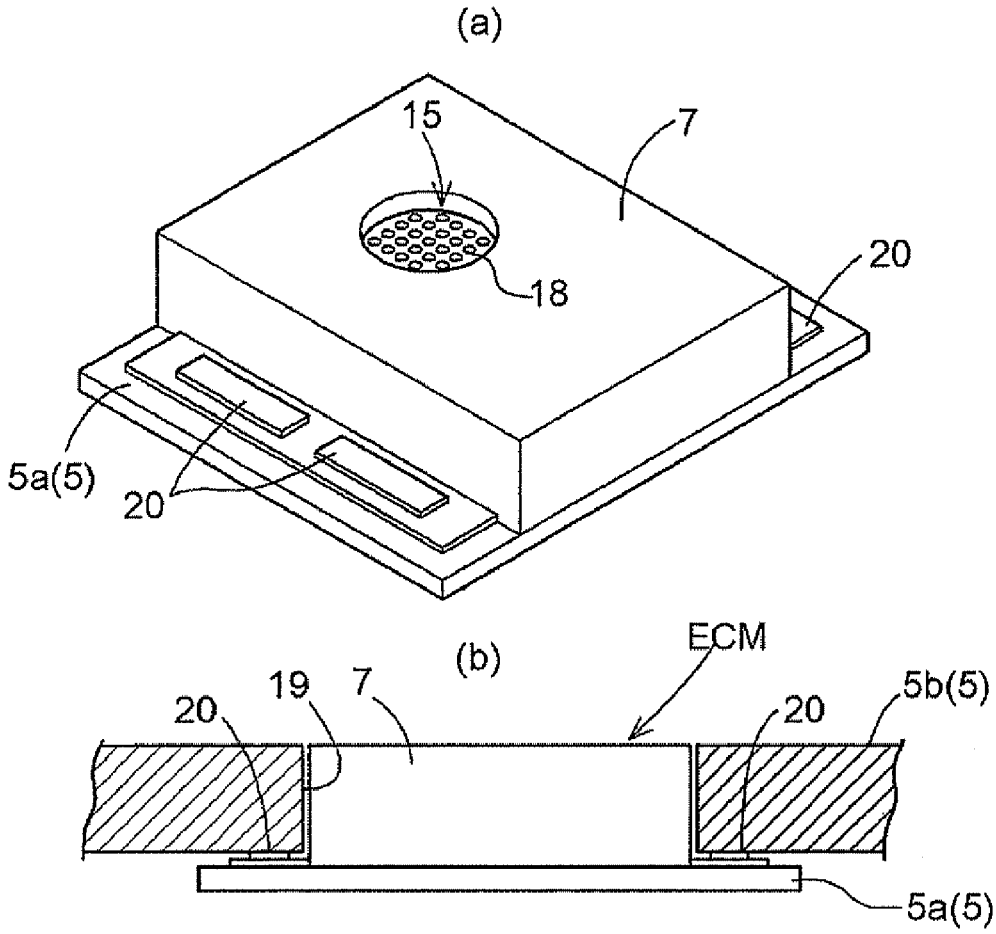
〔Fig 12〕
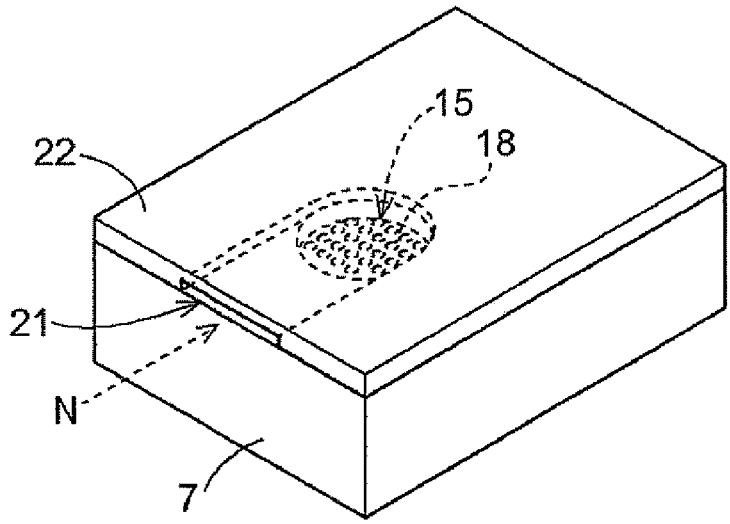

〔Fig 13〕
(PRIOR ART)
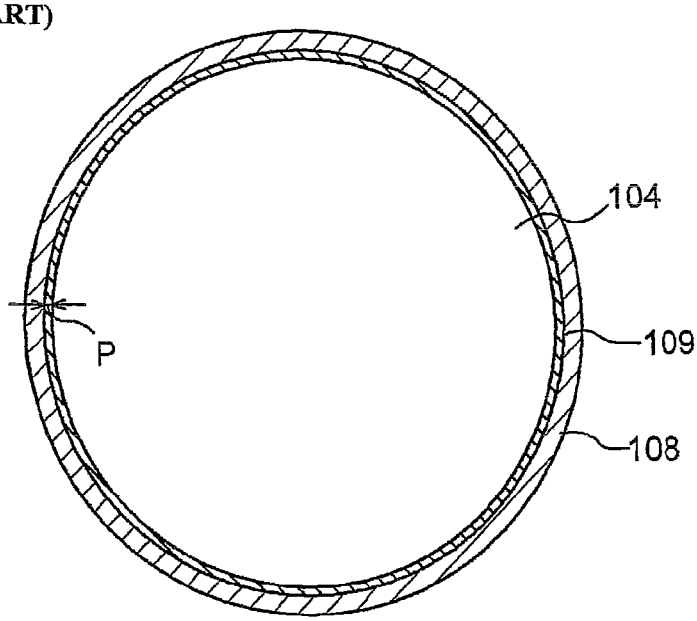
〔Fig 14〕
(PRIOR ART)
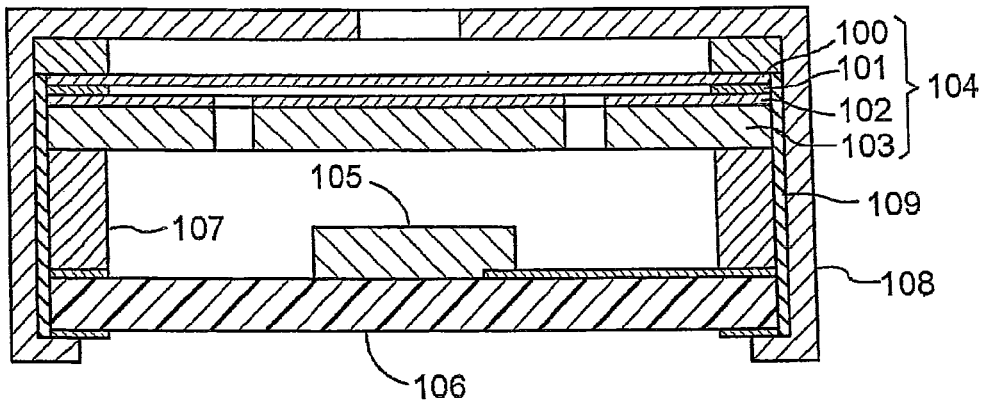
〔Fig 15〕
(PRIOR ART)
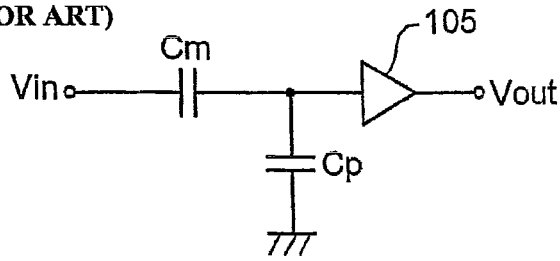

ELECTRET CONDENSER MICROPHONE

TECHNICAL FIELD

The present invention relates to an electret condenser microphone comprising a capacitor section including a fixed electrode having an electret member and a diaphragm electrode, a circuit board including a converter circuit for converting variations of capacitance of the capacitor section caused by vibrations of the diaphragm electrode to electric signals for output, conducting elements for making the capacitor conductive with the circuit board, and a casing section housing the circuit board and the conducting elements.

BACKGROUND ART

With the electret condenser microphone noted above, the diaphragm electrode is vibrated by inputted sounds to vary the capacitance of the capacitor section, as a result of which the converter circuit outputs electric signals in response to the variations of the capacitance of the capacitor section. Thus, the electret condenser microphone serves for outputting electric signals in response to inputted sounds.

A conventional electret condenser microphone will be described with reference to FIGS. 13 and 14. FIG. 13 is a cross section and FIG. 14 is a vertical section of the microphone.

The conventional electret condenser microphone comprises a capacitor section 104 including a fixed electrode 103 having a diaphragm 100, a spacer 101 and an electret member 102. The conventional electret condenser microphone further comprises a metal casing section 108 accommodating the capacitor section 104, and a circuit board 106 including a converter circuit 105 for converting variations of capacitance of the capacitor section 104 caused by vibrations of the diaphragm electrode 100 to electric signals for output. Also, the conventional electret condenser microphone comprises a ring-shaped conducting section 107 arranged within the casing section 108 for allowing the capacitor section 104 to be conductive with the circuit board 106, and an insulating tubular member 109 enclosing the capacitor section 104, circuit board 106 and conducting section 107 (see Patent Document 1, for example).

As shown in FIG. 13, according to this electret condenser microphone, the casing section 108 has a circular shape as viewed from top and the capacitor section 104 also has a circular shape as viewed from top.

According to another example of the conventional devices, the casing section has a rectangular shape as viewed from top and the capacitor section also has a rectangular shape as viewed from top (see Patent Document 2, for example).

Patent Document 1:

Japanese Patent Unexamined Publication No. 2001-8293

Patent Document 2:

Japanese Patent Unexamined Publication No. 2003-78997

SUMMARY OF THE INVENTION

With such electret condenser microphones, apart from the capacitance of the capacitor section, parasitic capacitance is generated by interaction between the conductive members. As shown in FIG. 15 representing an equivalent circuit diagram of an electret condenser microphone, an input signal Vin is divided by diaphragm line capacitance Cm, which is the capacitance of the capacitor section, and by parasitic capacitance Cp. The input signal inputted to the converter circuit

105 would be attenuated as the parasitic capacitance Cp is increased. Thus, it is required to reduce the parasitic capacitance in order to enhance the sensitivity of the electret condenser microphone.

As the parasitic capacitance, parasitic capacitance generated between the capacitor section and the metal casing section is conceivable. Such parasitic capacitance increases with a decrease in a distance, as viewed from top, between an outer portion of the capacitor section and the metal casing section.

According to the electret condenser microphone disclosed in Patent Document 1 noted above, as shown in FIG. 13, the casing section 108 has a circular shape as viewed from top and the capacitor section 104 also has a circular shape as viewed from top. A distance P between the outer side of the capacitor section 104 and the casing section 108 is uniform over the entire circumference of the capacitor section 104. The distance P is short.

Further, according to the electret condenser microphone disclosed in Patent Document 2 noted above, the casing section has a rectangular shape as viewed from top and the capacitor section also has a rectangular shape as viewed from top. A distance between the outer sides of the capacitor section and the casing section is uniform over the entire circumference of the capacitor section. The distance is short.

Therefore, an amount of parasitic capacitance generated is increased in the conventional electret condenser microphones, and thus there is a possibility of hampering enhancement of the sensitivity of the electret condenser microphones.

The present invention has been made having regard to the above-noted drawback, and its object is to provide an electret condenser microphone that can reduce parasitic capacitance and realize sensitivity enhancement.

In order to achieve the above-noted object, a characteristic feature of an electret condenser microphone in accordance with the present invention lies in comprising a capacitor section including a fixed electrode having an electret member and a diaphragm electrode, a casing section housing the capacitor section, a circuit board including a converter circuit for converting variations of capacitance of the capacitor section caused by vibrations of the diaphragm electrode to electric signals for output, and conducting elements for making the capacitor conductive with the circuit board, wherein the casing section has a shape as viewed from top different from a shape of the capacitor as viewed from top to provide different distances between outer sides of the capacitor section and the casing section circumferentially of the capacitor section as viewed from top, and wherein the casing section includes a first casing portion made of an electrically insulating material and having the conducting elements arranged inwardly thereof, and a second casing portion made of an electrically insulating material placed on the first casing portion for insulation.

The shape of the casing section and the shape of the capacitor section are different as viewed from top to provide, circumferentially of the capacitor section, parts having a short distance and parts having a long distance between the outer sides of the capacitor section and the casing section. In the parts where the distance between the outer portion of the capacitor section and the casing section is long, parasitic capacitance can be reduced owing to the long distance. The distance between the outer sides of the capacitor section and the casing section is not uniformly long over the entire circumference of the capacitor section. In some parts, the distance between the outer sides of the capacitor section and the casing section is short, which can minimize the size of the casing section as viewed from top.

Thus, the present invention can reduce the size of the casing section as viewed from top while realizing sensitivity enhancement.

The first casing portion is made of an insulating material and includes the conducting elements arranged inwardly thereof to make the capacitor section conductive with the circuit board. Thus, parasitic capacitance can be prevented from being generated between the first casing portion and conducting elements. Also, since the conducting elements are arranged inwardly of the first casing portion, the distance between the outer sides of the first casing portion and the conductive portion can be increased as viewed from top. As a result, even when a metal plating treatment is executed on the outer sides of the first casing portion, parasitic capacitance can be reduced.

Further, the first casing portion has the conducting elements and thus is capable of acting as a member for supporting the conducting elements as well. Also, the conducting elements can be arranged within the casing section by simply placing the second casing portion on the first casing portion. As a result, the entire construction can be simplified.

Another characteristic feature of the electret condenser microphone in accordance with the present invention lies in that the first casing portion includes a tubular portion and a plurality of projecting portions arranged at intervals circumferentially of the tubular portion and projecting inwardly of the tubular portion, and wherein the conducting elements are arranged in distal ends of the projecting portions.

The conducting elements are not provided over the entire circumference of the tubular portion, but are provided only in the projecting portions arranged at intervals circumferentially of the tubular portion. Thus, the area where the conducting elements are present can be reduced as viewed from top, thereby to reduce the surface area of the conducting elements. As a result, the conducting elements can be remote from the other conductive members as viewed from top. At the same time, the area where the conducting elements face the other conductive members can be decreased, thereby to reduce parasitic capacitance.

Another characteristic feature of the electret condenser microphone in accordance with the present invention lies in that one of the shape of the casing section as viewed from top and the shape of the capacitor section as viewed from top is rectangular, and the other of them is circular.

By simply making one of the shapes of the casing section and capacitor section as viewed from top rectangular and the other circular, different distances can be provided between the outer sides of the capacitor section and the inner sides of the casing section circumferentially of the capacitor section as viewed from top. As a result, the shapes of the casing section and capacitor section can represent simple configurations to realize a simplified construction.

BRIEF DESCRIPTION OF THE DRAWINGS

FIG. 1 is an exploded perspective view of an electret condenser microphone in a first embodiment;

FIG. 2 is a view in vertical section of the electret condenser microphone in the first embodiment;

FIG. 3 is a perspective view of a second casing portion;

FIG. 4 is a cross sectional view of the electret condenser microphone in the first embodiment;

FIG. 5 is another cross sectional view of the electret condenser microphone in the first embodiment;

FIG. 6 is an exploded perspective view of an electret condenser microphone in a second embodiment;

FIG. 7 is a view in vertical section of the electret condenser microphone in the second embodiment;

FIG. 8 is an exploded perspective view of an electret condenser microphone in a third embodiment;

FIG. 9 is a cross sectional view of the electret condenser microphone in the third embodiment;

FIG. 10 is another cross sectional view of the electret condenser microphone in accordance with the third embodiment of the present invention;

FIG. 11 a view showing an electret condenser microphone in a fourth embodiment;

FIG. 12 a view showing an electret condenser microphone in a fifth embodiment;.

FIG. 13 is a cross sectional view of a conventional electret condenser microphone;

FIG. 14 is a view in vertical section of the conventional electret condenser microphone; and FIG. 15 is an equivalent circuit diagram of an electret condenser microphone.

DETAILED DESCRIPTION OF THE INVENTION

Electret condenser microphones embodying the present invention will be described with reference to the drawings.

[First Embodiment]

An electret condenser microphone in a first embodiment will be described first.

As shown in FIGS. 1 and 2, this electret condenser microphone comprises a capacitor section 3 including a diaphragm 1 acting as a diaphragm electrode and a back electrode plate 2 acting as a fixed electrode, a casing section 7 for accommodating the capacitor section 3, a circuit board 5 provided with a converter circuit 4 for converting variations of the capacitance of the capacitor section 3 generated by vibrations of the diaphragm 1 into electric signals for output, and conducting elements 6 arranged inside the casing section 7 for making the capacitor section 3 and the circuit board 5 conductive with each other.

The capacitor section 3 includes the disk-shaped diaphragm 1, a ring-shaped spacer 8, and the disk-shaped back electrode plate 2 which are laid to form a circular shape as viewed from top. The capacitor section 3 is formed as a capacitor having the diaphragm 1, spacer 8 and back electrode plate 2 stacked in the mentioned order on the surface adjacent the circuit board 5 with an interval defined by the spacer 8 between the diaphragm 1 and the back electrode plate 2.

The diaphragm 1 includes a conductive vibrating membrane 9 and a ring-shaped conductive frame 10 for supporting the vibrating membrane 9. The diaphragm 1 is conductive with the circuit board 5 through the conducting elements 6.

The back electrode plate 2 is provided with an electret member 11 opposed to the vibrating membrane 9, and a plurality of through holes 12 penetrate the back electrode plate 2 and the electret member 11. The back electrode plate 2 is electrically conductive with the circuit board 5 through a through hole not shown.

The circuit board 5 is made of an electrically insulating material (polyimide, glass epoxy, for example). Although not shown, the circuit board 5 has a metal wiring pattern formed thereon. The converter circuit 4 is mounted on the circuit board 5, and is connected to the metal wiring pattern. The converter circuit 4 is formed of an impedance converter (IC) for outputting analog signals or digital signals.

The casing section 7 includes a first casing portion 13 made of an electrically insulating material (polyimide, glass epoxy, for example) and having the conducting elements 6 provided inside thereof, and a second casing portion 14 made of an electrically insulating material (polyimide, glass epoxy, for example) and placed on the first casing portion 13. The casing section 7 forms a rectangular shape as viewed from top by laying the first casing portion 13 over the second casing portion 14, both of which are formed of substrate elements made of the insulating material.

Since the first casing portion 13 of the casing section 7 is formed of the substrate element made of the insulating material, a metal plating treatment is executed on outer side surfaces thereof to improve its shielding performance. Similarly, since the second casing portion 14 of the casing section 7 is formed of the substrate element made of the insulating material, a metal plating treatment is executed on outer side surfaces and outer surface peripheral edge portions except for an upper surface, inner surfaces and inner surface peripheral edge portions thereof to improve its shielding performance. Copper foil is applied to the front surface and the back surface of the substrate elements. Since the upper surface of the second casing portion 14 acts as the front surface, copper foil is applied to the upper surface of the second casing portion 14.

The first casing portion 13 includes a tubular portion 13*a* having a rectangular shape as viewed from top and three projecting portions 13*b* arranged at intervals circumferentially of the tubular portion 13 and projecting inward from the tubular portion 13*a*. The conducting elements 6 are provided in distal ends of the three projecting portions 13*b*, respectively.

As shown in FIG. 3, the second casing portion 14 is formed of two substrate elements 14*a* and 14*b* made of the insulating material and laid one over the other. The second casing portion is shaped into a recess with an upper side thereof closed and a lower side thereof opened. The second casing portion 14 includes a fit-in space B formed inside thereof for receiving the circular capacitor section 3. The substrate element 14*a* closing the upper side of the second casing portion 14 has an acoustic hole 15 and a cut-out portion 16 communicating with the acoustic hole 15. The cut-out portion 16 acts as a vent hole allowing the interior of the casing section 7 to communicate with the exterior thereof. It should be noted that a metal plating treatment is executed also on inner peripheries of the acoustic hole 15.

As shown in FIG. 1, the first casing portion 13, diaphragm 1, spacer 8, back electrode plate 2, a mesh element 18 made of a conductive material, and second case portion 14 are stacked on the circuit board 5 provided with the converter circuit 4 in the mentioned order. In this way, the electret condenser microphone is formed to be a rectangular parallelepiped. The circuit board 5, first casing portion 13 and second casing portion 14 are rectangular as seen from top and have the same or approximately the same size. The components are assembled in the mentioned order to form the electret condenser microphone including the back electrode plate 2 arranged forwardly of the diaphragm 1 as viewed from the acoustic hole 15 of the second casing portion 14.

With this electret condenser microphone, the capacitor section 3 is supported by the conducting elements 6 provided in the first casing portion 13 and the back surface of the second casing portion 14 which hold the capacitor section 3 as vertically sandwiched therebetween. The capacitor section 3 is fitted into the fit-in space B formed in the second casing portion 14 to position the capacitor section 3 in the horizontal direction. The mesh element 18 is arranged between the back electrode plate 2 and second casing portion 14, thereby enhancing the shielding effect and protecting the capacitor section 3 from dust.

With this electret condenser microphone, the casing section 7 has a rectangular shape as viewed from top and the capacitor section 3 has a circular shape as viewed from top. Distances between the outer sides of the capacitor section 3 and the inner side portions and outer sides of the casing section 7, as viewed from top, are different in the circumferential direction of the capacitor section 3, thereby to reduce parasitic capacitance.

More particularly, since the casing section 7 is formed of the substrate elements made of an insulating material and plated on the side surfaces thereof, parasitic capacitance is generated between the outer sides of the capacitor section 3 and the outer sides of the casing section 7. As shown in FIG. 4, between the second casing portion 14 of the casing section 7 and the capacitor section 3 in the circumferential direction of the capacitor section 3, are formed close parts R1 having a short distance between the outer sides of the capacitor section 3 and the outer sides of the second casing portion 14, and remote parts R2 and R3 having long distances between the outer sides of the capacitor section 3 and the outer sides of the second casing portion 14.

In the remote parts R2 and R3, the large distances between the outer sides of the capacitor section 3 and the outer sides of the second casing portion 14 result in a reduced amount of parasitic capacitance generated. Further, in the remote parts R2 and R3, air layers can be formed by providing spaces between the outer sides of the capacitor section 3 and the inner sides of the second casing portion 14, thereby reducing the amount of parasitic capacitance generated. On the other hand, in the close parts R1, the short distance between the outer sides of the capacitor section 3 and the outer sides of the second casing portion 14 reduces the size of the casing section 7 as viewed from top.

Thus, the close parts R1 and remote parts R2 and R3 are formed circumferentially of the capacitor section 3 in an attempt to reduce the parasitic capacitance generated between the capacitor section 3 and the casing section 7 while reducing the size as viewed from top.

Parasitic capacitance is generated also between the conducting elements 6 and the outer sides of the casing section 7. As shown in FIG. 5, the conducting elements 6 are arranged in the distal ends of the plurality of the projections 13*b* provided for the first casing portion 13, which allows contacting areas between the diaphragm 1 and the circuit board 5 to be reduced as viewed from top. In this way, the areas for making the diaphragm 1 conductive with the circuit board 5 are minimized, thereby to reduce the parasitic capacitance generated between the conducting elements 6 and the outer sides of the first casing portion 13. Moreover, it is also intended to reduce the parasitic capacitance generated between the conducting elements 6 and the outer sides of the first casing portion 13 by increasing a distance Q between the conducting elements 6 and the outer sides of the first casing portion 13 as viewed from top.

As noted above, it is intended to reduce the parasitic capacitance between the capacitor section 3 and casing section 7 and between the conducting elements 6 and casing section 7. Further, it is also possible to reduce the parasitic capacitance between gate pads provided on the front and back sides of the circuit board 5 conductive with the conducting elements 6 and ground pads provided on the back side of the circuit board 5.

More particularly, since the conducting elements 6 are arranged in the distal ends of the projections 13*b* of the first casing portion 13, the gate pads provided on the front and back sides of the circuit board 5 are arranged only in positions where the conducting elements 6 are provided as viewed from top. As a result, as shown in FIG. 5, the portions for establishing a conductive state between the gate pads and ground pads of the circuit board 5 coincide with the positions where the conducting elements 6 are present. Thus, a reduction of the parasitic capacitance is achieved by reducing the area of the conducting portions as viewed from top.

[Second Embodiment]

Next, an electret condenser microphone in a second embodiment will be described. The second embodiment is a modification of the first embodiment described above, which provides a different vertical positional relationship between the diaphragm 1 and back electrode plate 2.

As shown in FIGS. 6 and 7, the first casing portion 13, back electrode plate 2, spacer 8, diaphragm 1 and second casing portion 14 are stacked and assembled in the mentioned order to the circuit board 5 having the converting circuit 4 thereon. Thus, the electret condenser microphone is formed to be a rectangular parallelepiped.

The positions of the diaphragm 1 and back electrode plate 2 are vertically reversed from the first embodiment to form the electret condenser microphone having a back-type construction.

[Third Embodiment]

Next, an electret condenser microphone in a third embodiment will be described. The third embodiment is a modification of the first embodiment described above, which provides a different shape of the casing section 7 as viewed from top.

As shown in FIG. 8, the first casing portion 13 and second casing portion 14 are square as viewed from top, which provides the casing section 7 with a square shape as viewed from top. The first casing portion 13, diaphragm 1, spacer 8, back electrode plate 2, mesh element 18 and second casing portion 14 are stacked and assembled in the mentioned order to the circuit board 5 having the converting circuit 4 thereon. Thus, the electret condenser microphone is formed to be cubic.

The first casing portion 13 has four projections 13*b*, and conducting elements 6 are provided in distal ends of the four projections 13*b*, respectively.

As shown in FIG. 9, the shape of the casing section 7 is square as viewed from top and the shape of the capacitor section 3 is circular as viewed from top. Circumferentially of the capacitor section 3 are formed close parts R4 having a short distance between the outer sides of the capacitor section 3 and the outer sides of the second casing portion 14 of the casing section 7, and remote parts R5 having a long distance between the outer sides of the capacitor section 3 and the outer sides of the second casing portion 14 of the casing section 7. This allows a reduction of the parasitic capacitance generated between the capacitor section 3 and the casing section 7 while reducing the size as viewed from top.

Further, as shown in FIG. 10, the conducting elements 6 are arranged in the distal ends of the plurality of the projections 13*b* in the first casing portion 13. This reduces the contacting areas between the diaphragm 1 and circuit board 5 as viewed from top while increasing the distance Q between the outer sides of the conducting elements 6 and first casing portion 13 as viewed from top. In this way, a reduction is made in the parasitic capacitance generated between the conducting elements 6 and casing section 7.

[Fourth Embodiment]

Next, an electret condenser microphone in a fourth embodiment will be described. The fourth embodiment is a modification of the first embodiment described above, which provides a different construction of the circuit board 5.

As shown in FIG. 11, the circuit board 5 includes a first substrate 5*a* for forming the electret condenser microphone and a second substrate 5*b* having a hole 19 for assembling the electret condenser microphone thereto.

The first substrate 5*a* is sized to extend laterally outwardly of the casing section 7 as viewed from top. The first substrate 5*a* has a plurality of terminals 20 mounted on the extending portions. The hole 19 of the second substrate 5*b* is capable of receiving the electret condenser microphone.

The electret condenser microphone is inserted into the hole 19 to allow the terminals 20 of the first substrate 5*a* to contact the second substrate 5*b*, thereby assembling the electret condenser microphone to the second substrate 5*b*.

Thus, the vertical height can be reduced by assembling the electret condenser microphone as inserted into the hole 19 of the second substrate 5*b*.

[Fifth Embodiment]

Next, an electret condenser microphone in a fifth embodiment will be described. The fifth embodiment is a modification of the first embodiment described above, which provides a direction of inputted sounds N.

As shown in FIG. 12, the casing section 7 is topped by an upper casing 22 having a sideways-opening cutout 21 for the acoustic hole. This allows the acoustic hole 15 of the casing section 7 to communicate with an outer side surface of the upper casing 22. Thus, it is also possible to form an electret condenser microphone of the lateral acoustic hole type for inputting sounds N from a side surface.

[Other Embodiments]

(1) According to the foregoing first to fifth embodiments, regarding the shape of the casing section 7 as viewed from top and the shape of the capacitor section 3 as viewed from top, one is formed to be rectangular while the other is formed to be circular. The shape of the casing section 7 as viewed from top and the shape of the capacitor section 3 as viewed from top are variable as appropriate as long as different distances can be provided between the outer sides of the capacitor section 3 and the inner and outer sides of the casing section 7 circumferentially of the capacitor section 3 as viewed from top.

(4) According to the foregoing first to fifth embodiments, the first casing portion 13 includes the tubular portion 13*a* and the projecting portions 13*b*. The shape of the first casing portion 13*a* is variable, such as having only the tubular portion, for example. In the case of having both of the tubular portion 13*a* and projecting portions 13*b*, the number and the positions of the projecting portion 13*b* may vary as appropriate.

(5) According to the foregoing first to fifth embodiments, the conducting elements 6 are provided in the distal ends of the projecting portions 13*b* of the first casing portion 13. The arrangement of the conducting elements 6 on the first casing portion 13 may vary as appropriate.

(6) The foregoing first to fifth embodiments show the construction where the back electrode plate 2 is arranged forwardly of the diaphragm 1 as viewed from the acoustic hole 15 of the second casing portion 14, and the back-type construction as examples of the electret condenser microphone relating to the present invention. Instead, a foil-type construction may be employed.

Industrial Utility

The present invention may be applied to varied types of electret condenser microphone comprising a capacitor section including a fixed electrode provided with an electret member and a diaphragm electrode, a circuit board provided with a converter circuit for converting variations of capacitance of the capacitor section caused by vibrations of the diaphragm electrode to electric signals for output, a conducting section for making the capacitor conductive with the circuit board, and a casing section for housing the circuit board and the conducting section, which can realize a reduction of parasitic capacitance and enhance sensitivity.

The invention claimed is:

1. An electret condenser microphone comprising:

a capacitor section including a fixed electrode having an electret member and a diaphragm electrode;

a casing section housing the capacitor section;

a circuit board including a converter circuit for converting variations of capacitance of the capacitor section caused by vibrations of the diaphragm electrode to electric signals for output; and conducting elements arranged inside of the casing section for making the capacitor conductive with the circuit board, wherein the casing section has a shape as viewed from top different from a shape of the capacitor as viewed from top to provide different distances between outer sides of the capacitor section and the casing section circumferentially of the capacitor section as viewed from top, wherein the casing section includes a first casing portion made of an electrically insulating material and having the conducting elements arranged inwardly thereof, and a second casing portion made of an electrically insulating material placed on the first casing portion for insulation, wherein the first casing portion includes a tubular portion and a plurality of projecting portions arranged at intervals circumferentially of the tubular portion and projecting inwardly of the tubular portion, and wherein the conducting elements are arranged in distal ends of the projecting portions.

2. An electret condenser microphone as defined in claim 1, wherein one of the shape of the casing section as viewed from top and the shape of the capacitor section as viewed from the top is rectangular, and the other of them is circular.

* * * * *

UNITED STATES PATENT AND TRADEMARK OFFICE

CERTIFICATE OF CORRECTION

PATENT NO. : 8,150,078 B2
APPLICATION NO. : 12/297576
DATED : April 3, 2012
INVENTOR(S) : Toshiro Izuchi et al.

It is certified that error appears in the above-identified patent and that said Letters Patent is hereby corrected as shown below:

Title Page, Column 2, Item (57) ABSTRACT, Line 6, delete "4 for" and insert -- for --

Signed and Sealed this
Seventeenth Day of July, 2012

David J. Kappos

David J. Kappos
*Director of the United States Patent and Trademark Office*